US007870642B1

(12) United States Patent
Finkelstein et al.

(10) Patent No.: US 7,870,642 B1
(45) Date of Patent: Jan. 18, 2011

(54) ANTI-SAG HINGE

(75) Inventors: Burl M. Finkelstein, Newnan, GA (US); Brett A. Mitchell, Newnan, GA (US); Thomas A. Thorsen, Wedowee, AL (US)

(73) Assignee: Kason Industries, Inc., Shenandoah, GA (US)

( * ) Notice: Subject to any disclaimer, the term of this patent is extended or adjusted under 35 U.S.C. 154(b) by 578 days.

(21) Appl. No.: 11/850,145

(22) Filed: Sep. 5, 2007

(51) Int. Cl.
*E05D 7/10* (2006.01)

(52) U.S. Cl. ..... 16/260; 16/242

(58) Field of Classification Search ..... 16/235, 16/245–247, 250–251, 260, 236–238, 242; 312/326

See application file for complete search history.

(56) References Cited

U.S. PATENT DOCUMENTS

| | | | |
|---|---|---|---|
| 2,027,888 | A | 1/1936 | Solomon |
| 2,581,104 | A | 1/1952 | Houlsby, Jr. |
| 2,615,194 | A | 10/1952 | Kreiner |
| 3,626,548 | A | 12/1971 | Grunert |
| 3,866,658 | A | 2/1975 | Smith |
| 4,156,301 | A | 5/1979 | Schneider et al. |
| D255,868 | S | 7/1980 | Berkowitz et al. |
| 4,407,044 | A | 10/1983 | Iseki |
| 4,991,259 | A | 2/1991 | Finkelstein et al. |
| 5,218,739 | A | 6/1993 | Lautenschlager |
| 5,491,930 | A | 2/1996 | La See |
| D395,590 | S | 6/1998 | Finkelstein |
| D401,134 | S | 11/1998 | Finkelstein |
| 6,049,946 | A | 4/2000 | Cress et al. |
| 6,152,554 | A | 11/2000 | Parisi |
| 6,202,255 | B1 | 3/2001 | Sitter |
| 6,374,458 | B1 | 4/2002 | Finkelstein |
| 7,055,214 | B1 | 6/2006 | Finkelstein |
| 7,584,523 | B1 * | 9/2009 | Finkelstein et al. ..... 16/260 |

* cited by examiner

*Primary Examiner*—William L. Miller
(74) *Attorney, Agent, or Firm*—Baker Donelson

(57) ABSTRACT

There is disclosed an anti-sag hinge (10) which includes a mounting flange assembly (12) pivotally coupled to a strap assembly (15). The mounting flange assembly includes a mounting flange (16) having four mounting holes (17) therethrough. The strap assembly includes a strap (31) extending from a cylinder portion (32). The strap includes four elongated mounting holes (42), a screw adjustment flange (43) having a threaded screw hole (44) therein. The strap also includes a moveable adjustment bracket (50) mounted for lateral movement relative to the underlying strap. The adjustment bracket also includes an adjustment screw mounting flange (52), a adjustment screw (53) extending through an adjustment bracket mounting hole (54) and threaded into screw adjustment flange screw hole. Lastly, the adjustment bracket includes four mounting holes (56) extending therethrough and generally in alignment with strap elongated mounting holes (42).

13 Claims, 2 Drawing Sheets

ANTI-SAG HINGE

TECHNICAL FIELD

This invention relates generally to door hinges, and more particularly to anti-sag hinges used for commercial refrigerator and freezer doors

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit.

These doors are heavy and thus a common problem that may occur over time is door sag, which may cause the door not to open freely as it drags against the underlying floor or be properly locked or sealed as it does not fully close. The sag is caused by hinge wear, structural shifting due to temperature cycling, impacts, abuse, poor design of the door and frame, or the hinges shifting on the mounting screws. Sag is difficult to overcome without extensive repair work, such as the removal and remounting of the hinges or the replacement of the door and frame.

Accordingly, there is a need in the art for an apparatus for compensating for the sag or misalignment of walk in type refrigerator and freezer doors. It is to the provision of such therefore that the present invention is primarily directed.

SUMMARY OF THE INVENTION

In a preferred form of the invention an anti-sag hinge for doors being suited from mating engagement with an associated cabinet or jamb, the anti-sag hinge comprises a mounting flange adapted to be mounted to a jamb, the mounting flange having a plurality of screw openings there through, and a strap assembly adapted to be mounted to a door and pivotally coupled to the mounting flange. The strap assembly has a strap with a plurality of screw openings there through, an adjustment bracket having a plurality of screw openings there through configured to be alignable with the strap screw openings, and a lateral adjuster which causes lateral relative movement between the strap and the adjustment bracket. With this construction, the door is adjusted relative to the jamb by movement of the lateral adjuster that causes lateral movement between the strap and the adjustment bracket.

DETAILED DESCRIPTION

Figure 1:
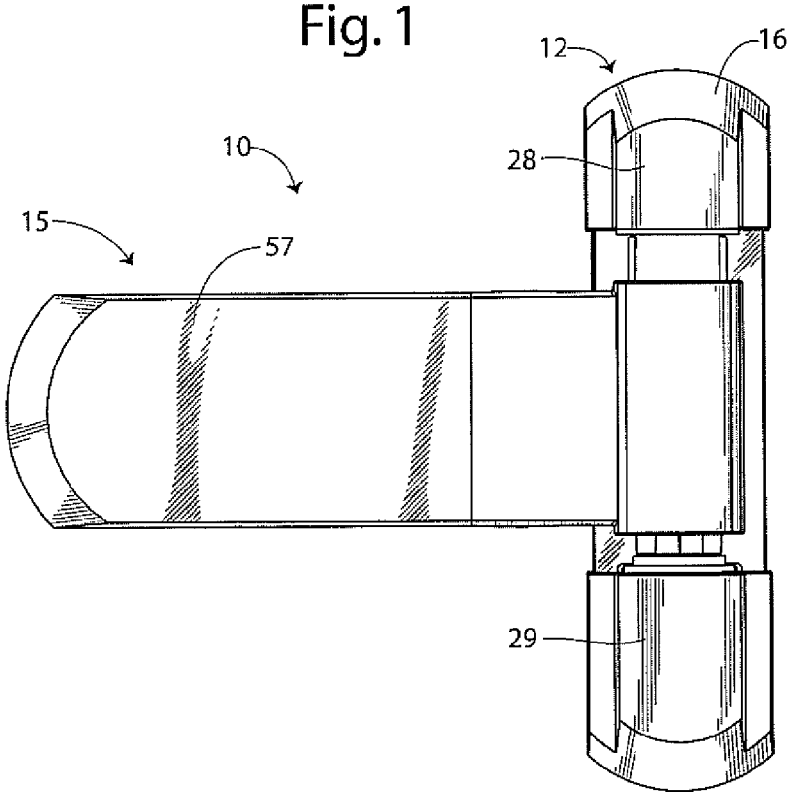
FIG. 1 is a front view of an anti-sag hinge embodying principles of the invention in a preferred form.
Figure 2:
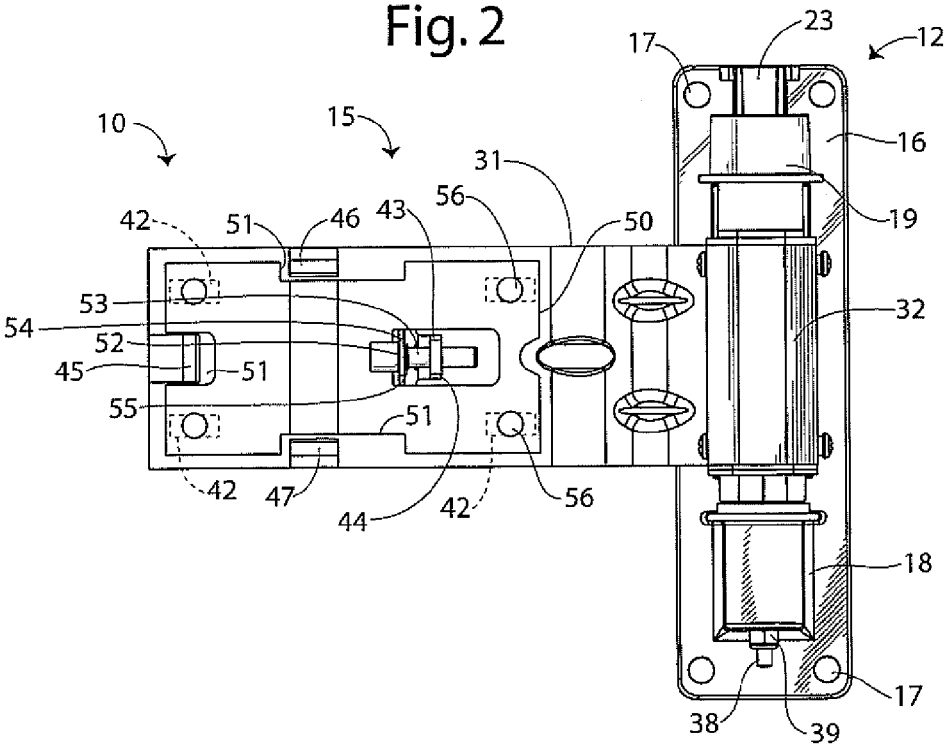
FIG. 2 is a front view of the anti-sag hinge of FIG. 1, shown with the covers removed.
Figure 3:
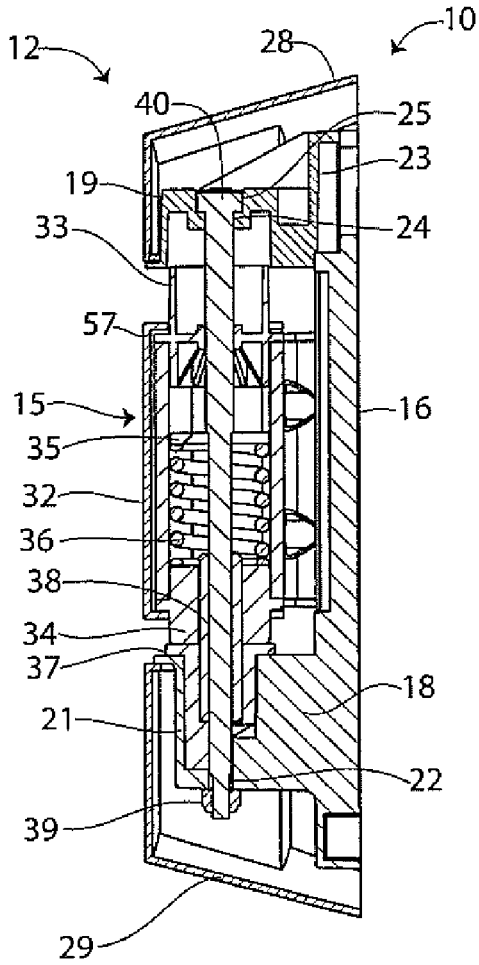
FIG. 3 is a cross-sectional side view of the anti-sag hinge of FIG. 1.
Figure 4:
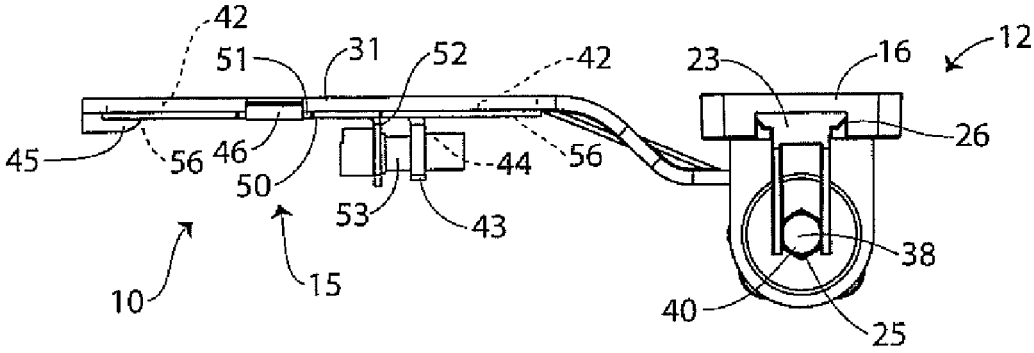
FIG. 4 is a top view of the anti-sag hinge of FIG. 1.

With reference next to the drawings, there is shown an anti-sag hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a mounting flange 16 having four mounting holes 17 therethrough adapted to receiving unshown mounting bolts or screws, a lower hinge barrel 18 extending from the mounting flange 16, and removably mated upper hinge barrel 19 extending from the mounting flange 16. The lower hinge barrel 18 includes an internally mounted cam 21 which enables the hinge to be a riser type hinge, although this is merely an option of the present invention. The lower hinge barrel 18 also includes a shoulder bolt hole 22 therethrough. The upper hinge barrel 19 includes a dove-tail flange 23 and a shoulder bolt hole 24 therethrough which includes a countersunk hexagonal hole portion 25. The dove-tail flange 23 is configured to removably mate with a tapered slot 26 extending from the top edge of the mounting flange 16. The mounting flange assembly 12 also includes a removable upper flange cover 28 configured to cover the upper hinge barrel 19 and a removable lower flange cover 29 configured to cover the lower hinge barrel 18. The covers 28 and 29 are provided for many reasons, including aesthetics and to meet the sanitary requirements employed in the industry as specified by the National Sanitation Foundation.

The strap assembly 15 includes a strap 31 extending from a cylinder portion 32, which all components are not necessarily cylindrical in shape. The cylindrical portion 32 includes an upper strap bearing 33, a lower strap bearing 34, a thrust washer 35, a spring 36 mounted between the lower strap bearing 34 and the thrust washer 35, and a cam follower 37 configured to mate with cam 21. A shoulder bolt 38 extends through the upper hinge barrel mounting bolt hole 24, the upper strap bearing 33, the thrust washer 35, the spring 36, the lower strap bearing 34, the cam follower 37, the cam 21, and through the lower hinge barrel mounting bolt hole 22. A hex nut 39 is threaded onto the lower end of the shoulder bolt while the head portion 40 of the shoulder bolt is configured to fit snugly within the hexagonal hole portion 25.

The strap 31 includes four elongated mounting holes 42, a screw adjustment flange 43 having a threaded screw hole 44 therein, an end guide 45, an upper guide 46 and a lower guide 47. The strap 31 also includes a moveable adjustment bracket 50 mounted for lateral movement relative to the underlying strap 31. The movement of the adjustment bracket 50 is limited by the end guide 45, upper guide 46 and lower guide 47, which each reside within notches 51 extending inwardly from the peripheral edge of the adjustment bracket 50. The adjustment bracket 50 also includes an adjustment screw mounting flange 52 and an adjustment screw 53 extending through an adjustment bracket mounting hole 54 and threaded into screw adjustment flange screw hole 44. A retaining ring is fitted upon the mounting screw 53 to secure its position. Lastly, the adjustment bracket 50 includes four mounting holes 56 extending therethrough and generally in alignment with strap elongated mounting holes 42. Again, the strap assembly also includes a cover 57 configured to fit snugly over the strap 31 and cylindrical portion 32 to protect and seal the interior of the strap assembly.

In use, the_hinge 10 is mounted to the refrigerator or freezer door in the conventional manner as is well known in the art. The mounting flange 16 is secured to the jamb by the use of screws (not shown) that extend through the mounting flange mounting holes 17 and into the jamb. A conventional walk-in refrigerator or freezer door is similarly secured to the hinge 10 by four screws (not shown) that extend through the four mounting holes 17 of the strap assembly adjustment bracket 50 and through the four elongated mounting holes 42 of the strap 31.

Next, the adjustment screw 53 is rotatably threaded into the threaded hole 44 of the screw adjustment flange 43 to cause relative movement between the adjustment bracket 50 and the underlying strap 31. This relative movement causes the movement of the door relative to the stationary jamb, as the elongated holes 42 allow movement of mounting screws and adjustment bracket. The movement of the door enables the door to be properly aligned. The mounting screws are then fully tightened into the door to prevent further movement of the strap. Moreover, should the door sag over time, the mounting screws are slightly loosened and the adjustment screw is merely threaded to once again cause movement of the door to a properly aligned position, as previously described.

Thus, the present invention fulfills the need in the art for an apparatus and method for compensating for the sag or misalignment of walk-in refrigerator and freezer doors that is, internal to the door hinge. This need is fulfilled by providing an anti-sag hinge for commercial walk-in refrigerator or freezer doors that includes adjustment bracket and screw that permit correction of alignment both during initial installation of the door to the jamb and realignment of the door due to frequent opening and closing of such doors.

It should be understood that other types of adjustable means may be provided between the strap and the adjustment bracket to vary the relative position therebetween.

While this invention has been described in detail with particular reference to the preferred embodiments thereof and the best mode of practicing same, it will be understood that variations and modifications can be effected within the spirit and scope of the invention as described herein above and as set forth in the appended claims.

The invention claimed is:

1. An anti-sag hinge comprising:

a mounting flange, and a strap assembly pivotally coupled to said mounting flange, said strap assembly including a strap, an adjustment bracket coupled to said strap for relative movement therebetween, and an adjuster coupled to said strap and said adjustment bracket, said adjuster being capable of varying the position of said adjustment bracket relative to said strap wherein said adjuster includes a first flange extending from said strap, a second flange extending from said adjustment bracket, and a threaded bolt coupled to one said flange and threadably coupled to the other said flange, whereby threaded movement of the threaded bolt causes relative movement between the first and second flanges, and thereby relative movement between the adjustment bracket and the strap.

2. The anti-sag hinge of claim 1 wherein said adjuster is capable of laterally varying the position of said adjustment bracket relative to said strap.

3. The anti-sag hinge of claim 1 wherein said strap includes guides which limit the movement of said adjustment bracket relative to said strap.

4. The anti-sag hinge of claim 1 wherein said strap includes guides which limit the movement of said adjustment bracket relative to said strap.

5. An anti-sag hinge comprising:

a mounting flange, and a strap assembly pivotally coupled to said mounting flange, said strap assembly including a strap, an adjustment bracket coupled to said strap for relative movement therebetween, and an adjuster coupled to said strap and said adjustment bracket, said adjuster being capable of varying the position of said adjustment bracket relative to said strap via movement of said adjuster wherein said strap includes elongated mounting holes and wherein said adjustment bracket includes mounting holes aligned with said strap elongated mounting holes.

6. An anti-sag hinge for doors being suited for mating engagement with an associated cabinet or jamb, the anti-sag hinge comprising:

a mounting flange adapted to be mounted to the jamb, said mounting flange having a plurality of screw openings there through;

a strap assembly adapted to be mounted to a door and pivotally coupled to said mounting flange, said strap assembly having a strap with a plurality of screw openings there through, an adjustment bracket having a plurality of screw openings there through configured to be alignable with said strap screw openings, and a lateral adjuster which causes lateral relative movement between said strap and said adjustment bracket, whereby the door is adjusted relative to the jamb by movement of the lateral adjuster that causes lateral relative movement between the strap and the adjustment bracket.

7. The anti-sag hinge of claim 6 wherein said lateral adjuster includes a first flange extending from said strap, a second flange extending from said adjustment bracket, and a threaded bolt coupled to one said flange and threadably coupled to the other said flange, whereby threaded movement of the threaded bolt causes relative movement between the first and second flanges, and thereby relative movement between the adjustment bracket and the strap.

8. The anti-sag hinge of claim 7 wherein said strap includes guides which limit the movement of said adjustment bracket relative to said strap.

9. The anti-sag hinge of claim 6 wherein said strap includes guides which limit the movement of said adjustment bracket relative to said strap.

10. The anti-sag hinge of claim 6 wherein said strap screw openings are elongated screw openings.

11. An anti-sag hinge for doors being suited for mating engagement with an associated cabinet or jamb, the anti-sag hinge comprising:

a mounting flange adapted to be mounted to the jamb, said mounting flange having a plurality of screw openings there through;

a strap assembly adapted to be mounted to a door and pivotally coupled to said mounting flange, said strap assembly having a strap and a laterally moveable adjustment bracket adapted for lateral movement relative to said strap, wherein said strap includes a first flange, wherein said adjustment bracket includes a second flange, and a threaded bolt is coupled to one said flange and threadably coupled to the other said flange, whereby threaded movement of the threaded bolt causes relative movement between the first and second flanges, and thereby relative movement between the adjustment bracket and the strap and whereby the door is adjusted relative to the jamb by movement of the adjustment bracket relative to the strap.

12. The anti-sag hinge of claim 11 wherein said strap includes guides which limit the movement of said adjustment bracket relative to said strap.

13. The anti-sag hinge of claim 11 wherein said strap includes elongated screw openings and said adjustment bracket has screw openings alignable with said strap elongated screw openings.

* * * * *